US006293052B1

(12) United States Patent
Varnado, Jr.

(10) Patent No.: US 6,293,052 B1
(45) Date of Patent: Sep. 25, 2001

(54) MULTIFUNCTIONAL COMPLEX

(76) Inventor: Bailey Varnado, Jr., 955 Sardonyx Way, Vacaville, CA (US) 95687-7803

( * ) Notice: Subject to any disclaimer, the term of this patent is extended or adjusted under 35 U.S.C. 154(b) by 0 days.

(21) Appl. No.: 09/621,098

(22) Filed: Jul. 21, 2000

Related U.S. Application Data

(63) Continuation-in-part of application No. 09/256,138, filed on Feb. 24, 1999, now abandoned.

(51) Int. Cl.[7] ..... E04H 3/26
(52) U.S. Cl. ..... 52/7; 52/8
(58) Field of Search ..... 52/6, 7, 8, 65; 434/72

(56) References Cited

U.S. PATENT DOCUMENTS 2,259,646 * 10/1941 Liehburg ..... 52/6
3,002,233 * 10/1961 Obata ..... 52/7
3,313,068 * 4/1967 Pinto ..... 52/8
3,487,595 * 1/1970 Schumann ..... 52/8
4,306,388 * 12/1981 Yuter ..... 52/6 X
4,686,799 * 8/1987 Kwake ..... 52/8
5,469,669 * 11/1995 Alter ..... 52/8
5,577,350 * 11/1996 Brisbin et al. ..... 52/6

* cited by examiner

*Primary Examiner*—Carl D. Friedman
(74) *Attorney, Agent, or Firm*—Harold D. Messner

(57) ABSTRACT

A multifunctional complex incorporates multiple uses and comprises a series of upright wall members including a first interior wall dividing the complex into at least a concert hall. The concert hall includes a stage structure excavated below ground level, a truncated annular dance floor surrounding the stage structure also excavated below ground level and a series of truncated pie-shaped audience seating sections radiating upwardly from the dance floor in which the lowest tier of open seating is above the dance floor by a height (H) where (H) is between 4 to 10 feet. The stage structure includes a rotatable central stage defining an axis of rotation and a plurality of pie shaped stationary platforms radially about the rotatable central stage. In one aspect, the central stage has a top surface a distance (H) above the dance floor where (H) is as defined, a circumferentially extending side face and an axis of rotation. Each of the plurality of pie shaped stationary platforms is inversely disposed relative to the circumferentially extending side face of the central stage and includes and apex segment remote from the side face, a radial axis of symmetry normal to the dance floor that bisects each of the plurality of pie shaped platforms. The stage structure resembles a star shape in cross section.

17 Claims, 8 Drawing Sheets

MULTIFUNCTIONAL COMPLEX

RELATED APPLICATION

This is a continuation-in-part of Ser. No. 09/256,138 filed Feb. 24, 1999 for "MULTIFUNCTIONAL COMPLEX 'STARLITE PAVILLION'" now abandoned.

This relates to a multifunctional complex or structure primarily for viewing concerts, plays, political conventions and the like and has particular reference to improvements in such structures to permit adding uses that include but not limited to a sports/ entertainment bar and a business area stacked one above the other adjacent to a concert hall.

BACKGROUND OF THE INVENTION

The prior art is replete with different concert hall designs in which combinations of uses are revealed. For example, in U.S. Pat. No. 3,002,233, Obata for "AUDITORIUM STRUCTURES", depicts an elongated hexagonal auditorium which is divided into dual halls by a slanted movable partition. Both halls have similarity designed raised stages and floor level seating that is non-permanent, each seating section having a pentagonal design in cross section. As a result, the length of the row of non-permanent seating closest to the stage is equal to that of the row of seats most remote from the stage.

Also, in U.S. Pat. No. 2,259,646 a horse-shoe shaped auditorium is shown having two stages one behind the other. However, there is no room for dancers adjacent to either stages and the seating sections are not concentrically located relative to the central stage.

Theater-in-the-round is also a design well-known in the art in which the audience sit in a circle around the stage. Drawbacks include the fact that the performers must remember to change their presentation direction in order to provide equal time to each segment of the audience. If the stage rotates, the performers must walk in a direction opposite to the direction rotation when they want to concentrate of one segment of the audience. If a dance space is provided, dancers block the sight lines of audience members in the first row or tier of seating.

SUMMARY OF THE INVENTION

The present invention relates to a multifunctional complex incorporating multiples uses and comprises a series of upright wall members arranged to form a rectangularly shaped structure in cross section. The wall members include a pair of parallel side walls, a back wall, a front wall parallel to said end wall and normal to the pair of side walls, a first interior wall parallel to said front and back walls, and a second interior wall parallel to said pair of side walls to divide the structure into a sports/entertainment bar at ground level and a separate concert hall. The concert hall is defined by a vertical axis centrally located within its portion of the structure, i.e., such axis being located about midway between the first interior wall and the back wall, and about midway between one of the side walls and the second interior wall. The central axis, however, is offset from the sports/entertainment bar.

Sight lines and enjoyability of the concert hall are enhanced by providing a series of inversely truncated pie shaped audience seating sections that radially surround an annular dance floor concentric of the central axis. (By the term inversely truncated pie shape, it is meant that apex of each seating section is most remote from the central axis and the non-apex elongated end is closest.) A stage means is symmetrically located relative to the central axis at an excavation level that is below ground level. However, most of the audience sections begin at ground level and are built upwards therefrom to ease most construction difficulties. That is, the concert hall includes a first ground level floor portion starting at the extremities of the first and second interior walls and the side and back walls, and thence extending inwardly toward the central vertical axis, and finally, terminating at an imaginary circle also concentric of the central axis. A second floor portion starts at the concentric circle and extends inwardly toward the central axis, but is angled downwardly from the first ground level floor portion to a horizontal pit floor region that is excavated below ground level a substantially amount, say 4 to 10 feet.

The stage means includes a rotatable central stage of circular cross section having an axis of rotation coincident the central axis and located within the pit floor region as well as a plurality of pie shaped stationary platforms located adjacent to the circumferential end surface of the rotatable stage. In horizontal cross section, the rotatable central stage and the plurality of pie shaped stationary platforms resembles a truncated star in which intersecting apex lines forming the points of the star are located at the stationary platforms and intersection of neighboring lines adjacent to the central axis is along an arc of a common circle. The stage means is supported by and extends vertically from the pit floor region to a height H that is below ground level where H is between 4 and 10 feet but the diameter of the rotatable stage is smaller than that of the pit floor region so as to leave a portion of the pit floor region free to form the annular dance floor previously mentioned.

The plurality of circumferentially spaced pie shaped stationary platforms each has an apex most remote from the central axis, an elongated radially extending non-apex end more closely adjacent to the rotatable stage and is defined by a radial axis that originates at the central axis and radiates outward therefrom in the manner of spokes of a wheel. The non-apex end of each of said stationary stages is positioned closely adjacent to the rotatable stage so that an entertainer can easily step from the rotatable stage to one of said plurality of stationary stages.

The series of truncated pie shaped audience seating sections each are tiered and radiate upward from the dance floor away from the central axis, each being bisected by vertical plane through one of the series of radial axes defining the stationary platforms and includes a non-apex truncated sub-section adjacent to the dance floor and apex section most remote from the stage means and the dance floor. The truncated non-apex sub-section is itself elevated above the dance floor by at least a height H so that entertainers on the rotatable stage can be seen even when dancers are present on said dance floor. Each of the series of seating sections also includes a plurality of tiered rows of individual seating in which the lowest tier of seating is at least at the elevation H above said dance floor as previously mentioned. Result: patrons who remain seated in the lowest tier of seating have an unobstructed view of the entertainers on the stage means even if dancers are present on the dance floor. Each of the series of seating section terminates in an individual suite located in and associated with the apex sub-section. As a result of the inverse pie shaped design of each seating section, patrons have the feeling of being individually entertained. Each of the suites is provided with multiple seating areas all situated above and to the rear of the tiered rows of individual seating. All seating areas have unobstructed sight lines to the stage means. Sliding glass means and video and sound means for televised viewing of the entertainers reside within each suite. An aisle system allows patrons to enter and exit their seats associated with each of the seating sections and well as enter and exit the dance floor easily.

In accordance with further aspects, the sports/entertainment bar includes a ground level floor, and seating and bar areas supported by the ground level floor. Its physical location within the structure is as follows: interior of and between an opposite of the pair of side walls (of the upright wall members) and the second interior wall, as well as between extended portions of the front and rear walls. In addition the seating and bar areas, an elevated stage area is located adjacent to the extended portion of the rear wall having an upright interior sub-wall upon which video and sound means is located, such video and sound means including a large television screen to allow display of one of (i) live performance from the concert hall and (ii) televised sports events exterior of the concert hall, but leaving ample area for live stage performances, if desired.

In accordance with still further aspects, the upright wall members used to form the sports/entertainment bar, are designed to extend well above the ground level floor to support a second story floor, the second story floor being attached to the upright wall members above the ground level floor for support of a business office area. The business office area includes a stairwell and elevator to permit entry and egress from the sports/entertainment bar to the business office area. The business office area also includes a series of offices, storage areas, bathrooms and a conference room.

DETAILED DESCRIPTION OF EMBODIMENTS

Figure 1:
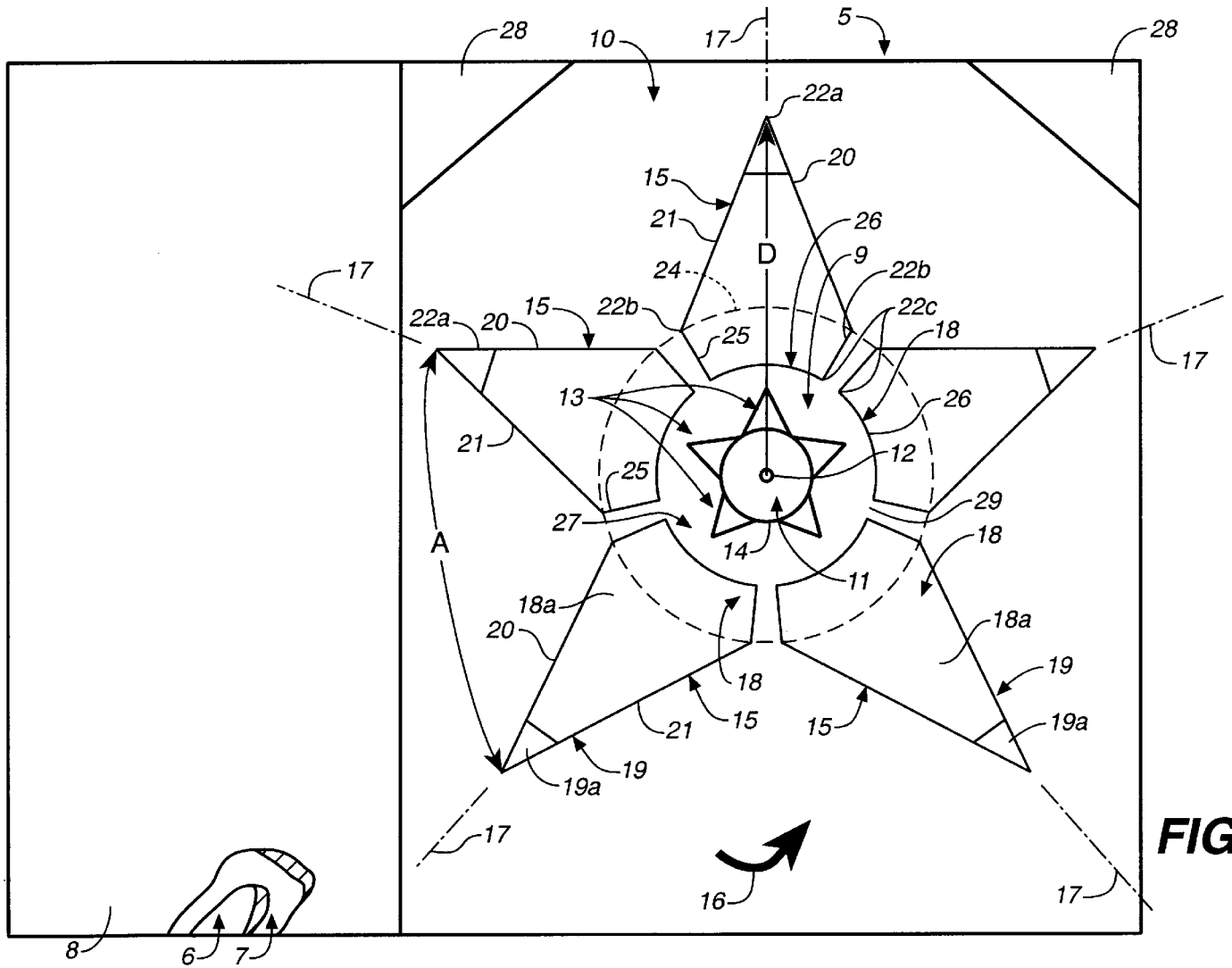
FIG. 1 is a plan view of a multifunctional complex in accordance with the invention showing an open-air concert hall having stage means surrounded by a series of pie shaped seating sections located adjacent to a stacked sports/entertainment bar and business office area overcovered by a roof.

In FIG. 1, a multifunctional complex 5 is shown constructed in accordance with the invention shown. The complex 5 is rectangular in cross section (i.e., relative to the earth's surface) and includes a stacked sports/entertainment bar 6 located under a second story business office area 7, both overcovered by a roof 8, and located adjacent to an open-air concert hall 10. Description of the elements comprising the complex 5 will now be set forth in detail below in an order that is inverse to their presentation above, viz, beginning with the concert hall 10.

Concert Hall 10

As shown in FIG. 1, the concert hall 10 comprises a stage means 9 that includes a rotatable central stage 11 having an axis of rotation 12, a plurality of pie-shaped stationary platforms 13 at circumferential edge 14 of the center stage 11, and a series of pie shaped seating sections 15. The central stage 11 is conventional having a series of drivers that rotate the stage 11 in an angular direction say as indicated by arrow 16. The plurality of stationary platforms 13 which is also a part of the stage means 9, are pie-shaped in cross section and are radially located closely adjacent to but not directly contacting the circumferential edge 14 of the central stage 11. Each of the stationary platforms 13 defines an axis of symmetry 17 (see FIG. 1A) and bisecting plane P that intersects the axis of symmetry 17. Each axis 17 radiates outward from the axis of rotation 12 in the manner of spokes of a wagon wheel. Each of the axes 17 are radially displaced from neighboring axes 17 by an angle A equal to about seventy-two degrees. Also defined by the axes 17 is the series of pie shaped seating sections 15 (See FIG. 2) each radially disposed from neighboring sections 15 by angle A and including a non-apex segment 18 associated with open seating area 18*a* and apex segment 19 associated with a suite 19*a* at the remote terminus of each of the seating section 15. Each suite 19*a* provides private seating. Each apex segment 19 associated with suite 19*a* and includes diverging side surfaces 20, 21 that intersect at cornering surfaces 22*a* at a distance D from the axis of rotation 12 of the central stage 11. Each side surface 20 or 21 terminates at cornering edge 22*b*. The cornering edges 22*b* together lay along a first imaginary circle 24 which is centered at the axis of rotation 12 of the central stage 11. The non-apex segment 18 begins from adjacent cornering edges 22*b* defining the first imaginary circle 24 and includes side surfaces 25 each inwardly converging to intersect an angular end surface 26 along cornering surface 22*c*. Note that the annular end surface 26 lies along an second imaginary circle 29 also centered at the axis of rotation 12 and interior of the first imaginary circle 24. Between the stationary platforms 13 and the angular end surface 26 of each non-apex segment 18 is an annular shaped dance floor 27 which is easily accessible to the audience as explained below. Control and stow areas 28 are provided at the corners of the concert hall 10.

Figure 2A:
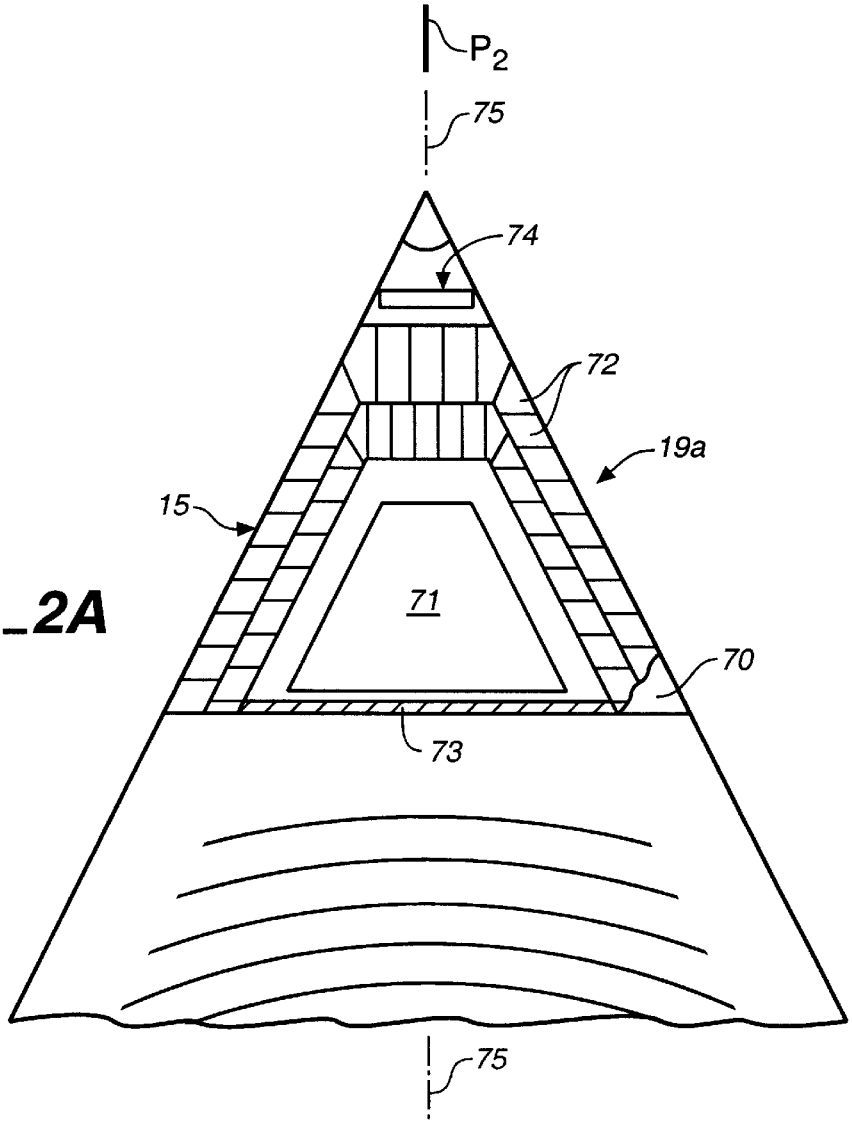
FIG. 2A is a detail plan view of a portion of one of the pie shaped seating sections of FIG. 1, viz., the apex section thereof.
Figure 2:
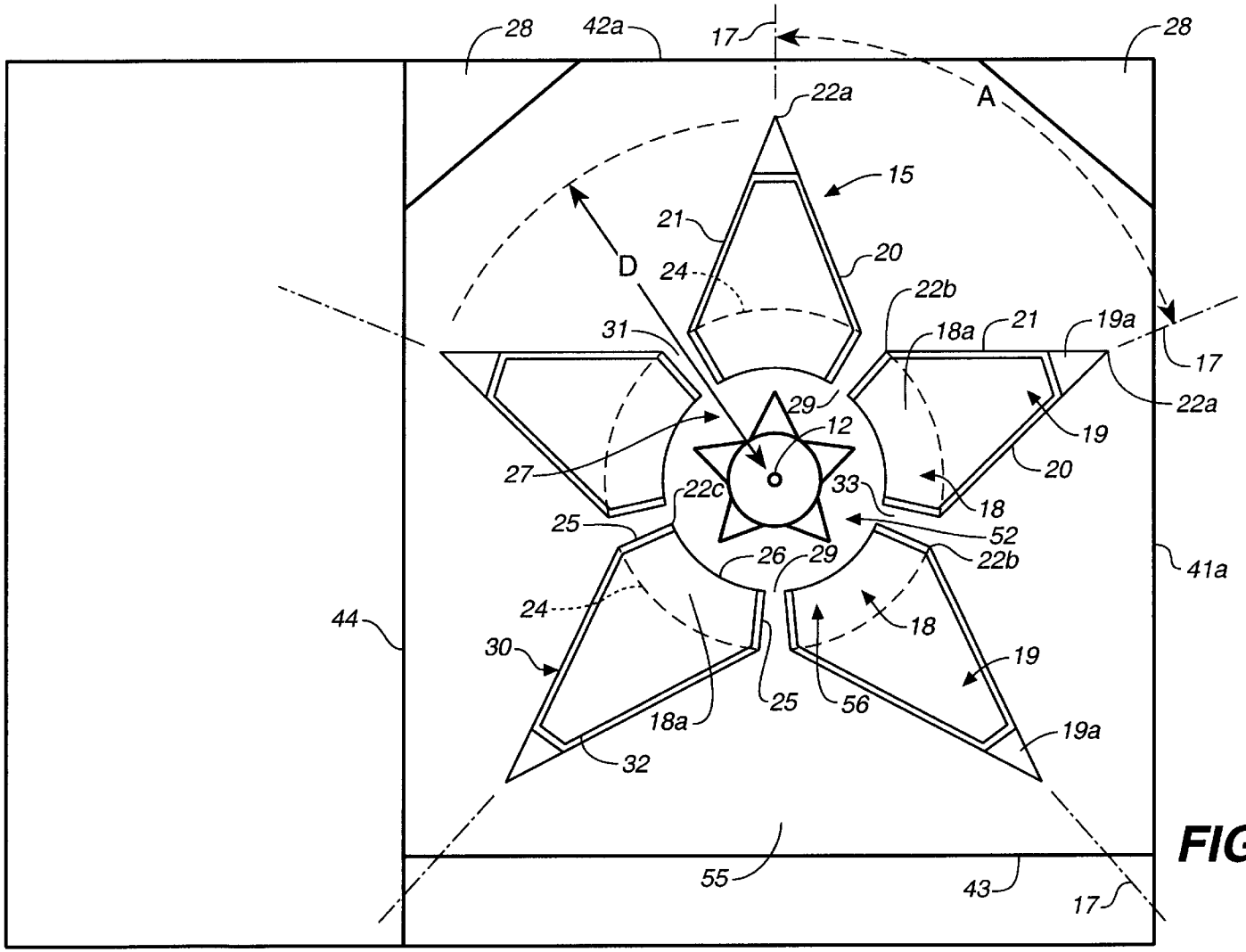
FIG. 2 is a plan view similar to FIG. 1 showing accessability features of the invention.

FIG. 2 shows how accessability relative to the pie shaped seating sections 15 and the dance floor 27, occurs.

As shown, a system of aisles 30 are provided consisting of main aisles 31, gallery aisles 32 and stage aisle 33. The main aisles 31 are located between adjacent and neighboring pie shaped seating sections 15. The gallery aisles 32 are found along the edges of the apex and non-apex segments 19, 18 of each of the series of pie shaped seating sections 15. The stage aisle 33 is similar to the main aisles 33 but extends across the dance floor 27.

Figure 3:
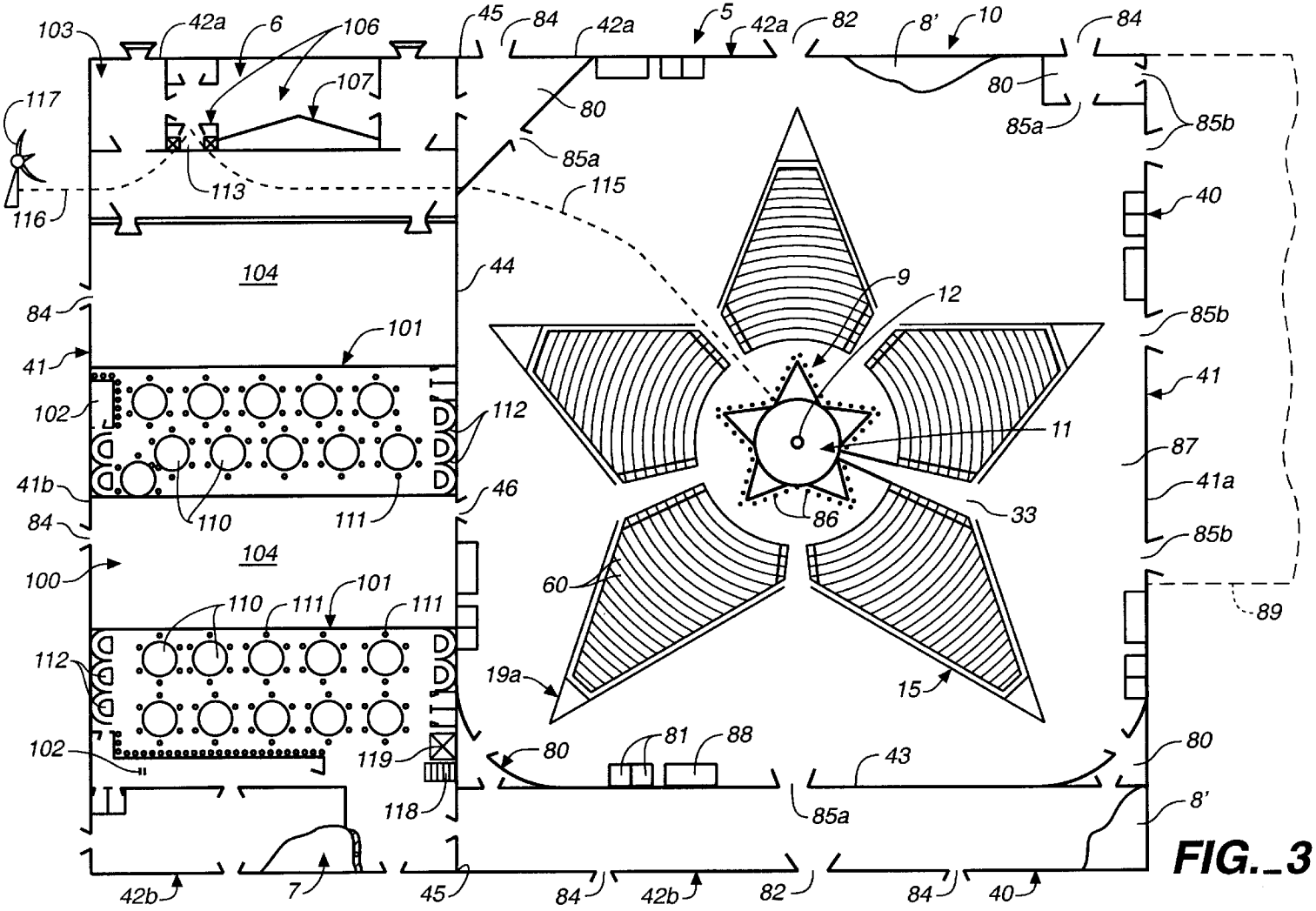
FIG. 3 is plan view of another embodiment of the invention similar to FIG. 1 but in which the complex is covered by a common roof and includes an additional dressing area shown in phantom line.

FIG. 3 shows another embodiment of the invention in which both the concert hall 10 and the stacked sports/entertainment bar 6, and business office area 7, are all overcovered by a common roof 8'.

As shown, concert hall 10, the stacked sports/entertainment bar 6, and business office area 7 are constructed using a series of upright wall members 40 arranged to form a rectangularly shaped structure in cross section. The wall members 40 include a pair of parallel side walls 41, a back wall 42*a*, a front wall 42*b* parallel to the back wall 42*a*, a first interior wall 43 parallel to the front and back walls 42*b*, 42*a*, a second interior wall 44 parallel to the pair of side walls 41 but interior thereof having ends 45 in contact with the front and back walls 42*b*, 42*a*, respectively, dividing the structure into the sports, entertainment bar 6 (at ground level) and the concert hall 10. A doorway 46 through the second interior wall 44 permits egress and entry between the concert hall 10 and the sports/entertainment bar 6 as explained below. Note also that the concert hall 10 includes a central vertical axis (not shown) coincident with the axis of rotation 12 of the central stage 11, such vertical axis being located about midway between the first interior wall 43 and the back wall 42, and about midway between side wall 41*a* of the pair of the side walls 41 and the second interior wall 44.

Elevational levels of various elements comprising the concert hall 10 are important in carrying out the invention. In this regard, reference is now made to FIGS. 1A, 3 and 6.

Figure 1A:
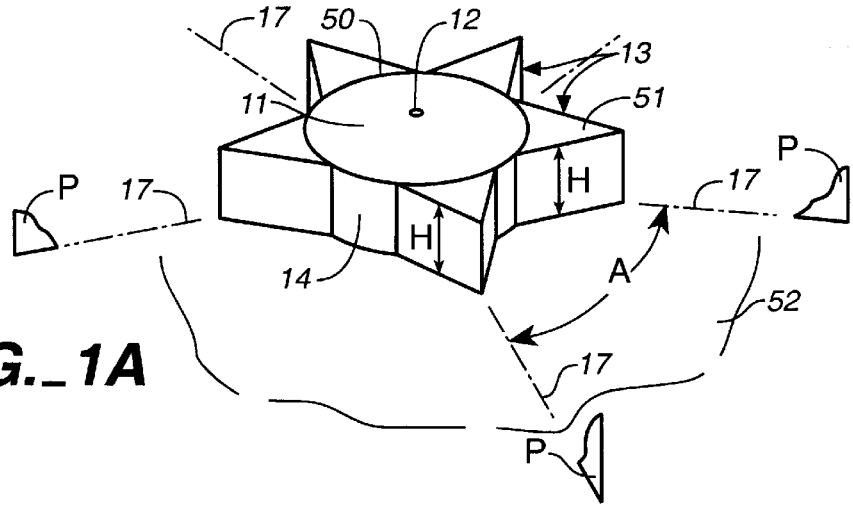
FIG. 1A is a perspective view of the stage means of the concert hall of FIG. 1 illustrating a rotatable center stage concentric of a central axis of rotation and a plurality of stationary platforms at the circumferential edge of the center stage.

In FIG. 1A, top surface 50 of the rotatable central stage 11 is seen to be parallel with top surface 51 of each of the plurality of pie-shaped stationary platforms 13 but at a height H above the dance floor 27 where H is in a range of 4–10 feet. The pit region 52 by which the central stage 11 and stationary platforms 13 are supported, is thus excavated a distance H below ground level assuming a first ground level floor portion 55 (see FIG. 2) is at ground level and a second floor portion 56 (also see FIG. 2)downwardly slopes from the first level floor portion 55 to the pit region 52. Note that the first level floor portion 55 is seen in FIG. 2 to be horizontal and to extend from the first and second interior walls 43, 44, the side wall 41*a* of the pair of side walls 41 and the back wall 42*a* and thence to the imaginary circle 24 previously mentioned. At the first concentric imaginary circle 24 the second floor portion 56 starts but shortly thereafter, terminates at the second concentric circle 29. Thus the second floor portion 56 is angled downwardly from the first ground level floor portion 55 to its intersection with the pit floor region 52. Since the pit floor region 52 is parallel to the first floor portion 55, i.e., both elements are horizontal with respect to the earth's surface and since the latter is much larger in area than the former, the defined dance floor 27 is annularly disposed with respect to an axis of symmetry (not shown) coincident to the axis of rotation 12 of the central stage 11.

Figure 6:
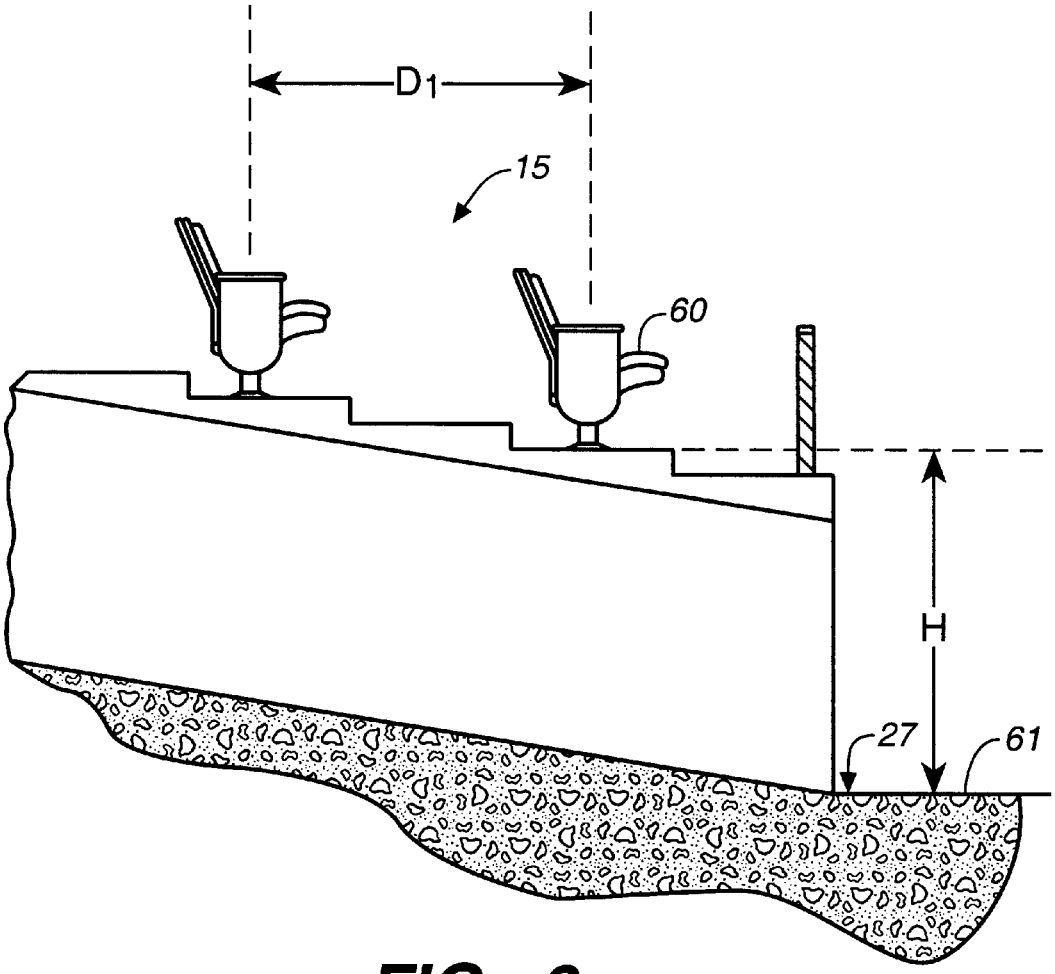
FIG. 6 is partial sectional view of a portion of one of the series of pie shaped seating sections, viz., the lowest tiers of seating.

FIG. 6 shows the series of pie shaped seating sections 15 are tiered but that first row of open seating 60 is located at a height H above top surface 61 of the dance floor 27 wherein H is defined hereinabove. In that way, entertainers on the rotatable stage 11 can be seen even when dancers are present on the dance floor 27. Returning to FIG. 3, note that where each of the series of truncated pie shaped audience seating sections 15 is associated with open seating 15*a* there are rows of seats 60 that are downwardly disposed from individual suites 19*a*. Each of the adjacent rows of seats 60 are separated by a distance D1, see FIG. 6.

FIG. 2A shows the individual suite 19*a* in detail.

As shown each suite 19*a* includes a ceiling 70, a table 71, lounges 72, a sliding glass partition 73 and video and sound means 74 for televised viewing of the entertainers on the central stage 11. Note that suite 19*a* of each of said series of truncated pie shaped audience seating sections 15 defines an axis of symmetry 75 and a bisecting plane P2.

Returning to FIG. 3, note these further elements comprise the concert hall 10, viz., storage areas 80, restrooms 81, exterior doorways 82, supply entrances 84 that can also serve as emergency exits, and interior doorways 85. Exterior doorways 82 may serve as main exterior entrances for concerts. Interior doorway 85*a* may serve as a main interior entrance to concert hall 10. The main stage means 9 is surrounded by stage lights 86. Entrance aisle 33 connects the stage means 9 with walkway 87 near to interior doorways 85*b*. Serving bars 88 provide beverages and snacks to patrons. The interior doorways 85*b* lead to backstage area 89.

Figure 4:
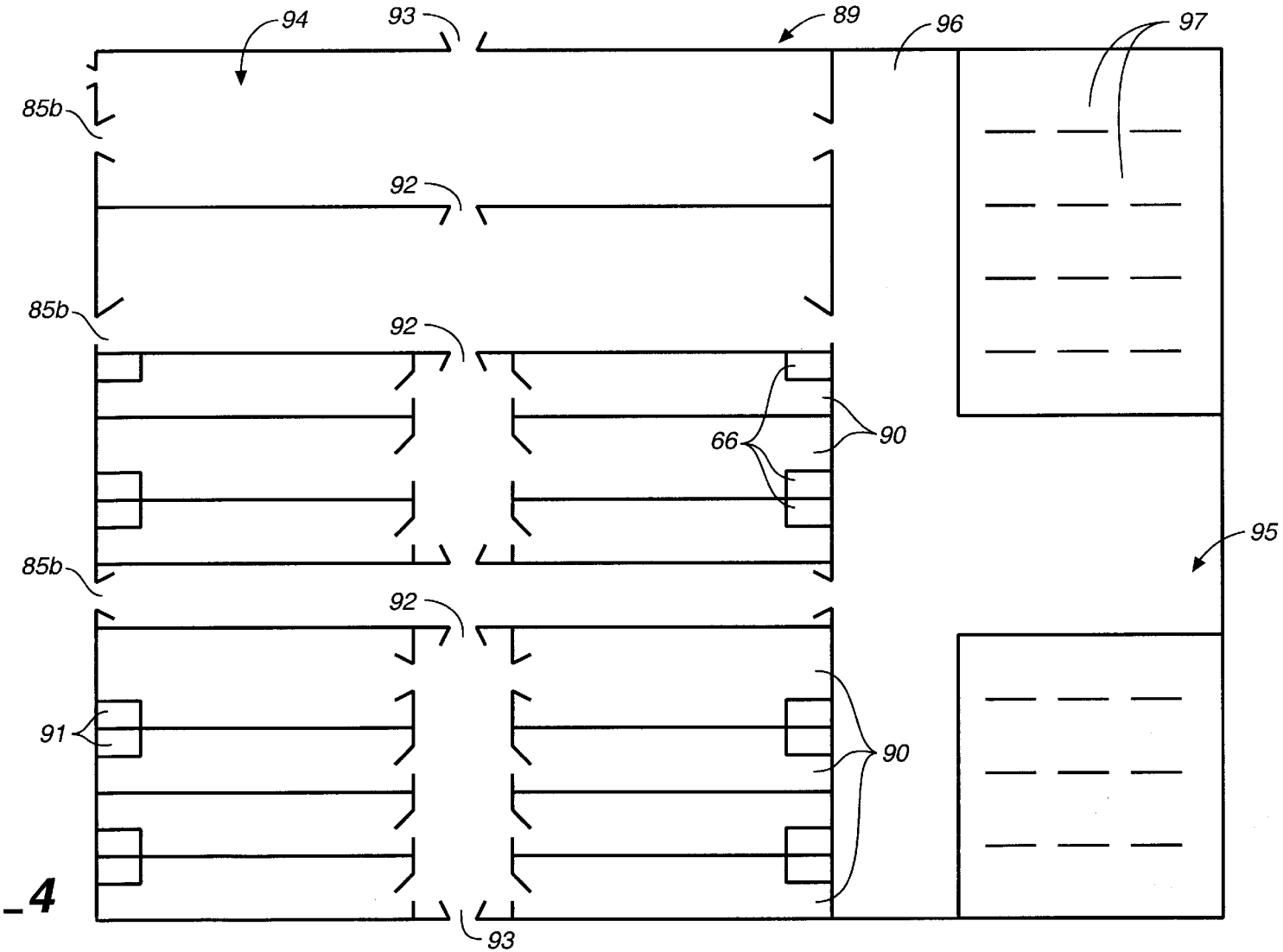
FIG. 4 is a detail plan view of the additional dressing area of FIG. 3.

FIG. 4 shows the backstage area 89 in detail.

As shown, the backstage area 89 includes interior doorways 85*b*, dressing rooms 90, restrooms 91, interior doorways 92, exterior exits 93, storage area 94 and parking lot 95. The parking lot 95 includes fire lane 96 and parking spaces 97.

Sports/Entertainment Bar 6

Figure 3A:
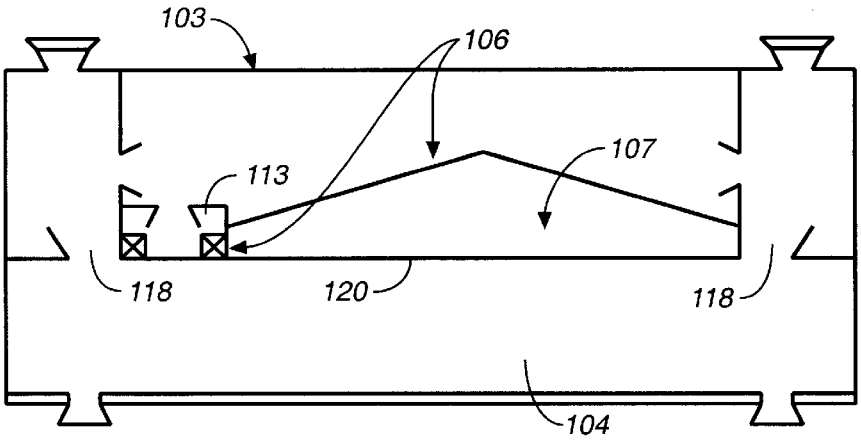
FIG. 3A is a detail plan view of a portion of the sports/entertainment bar of FIG. 3, viz., the stage and storage areas thereof.
Figure 3B:
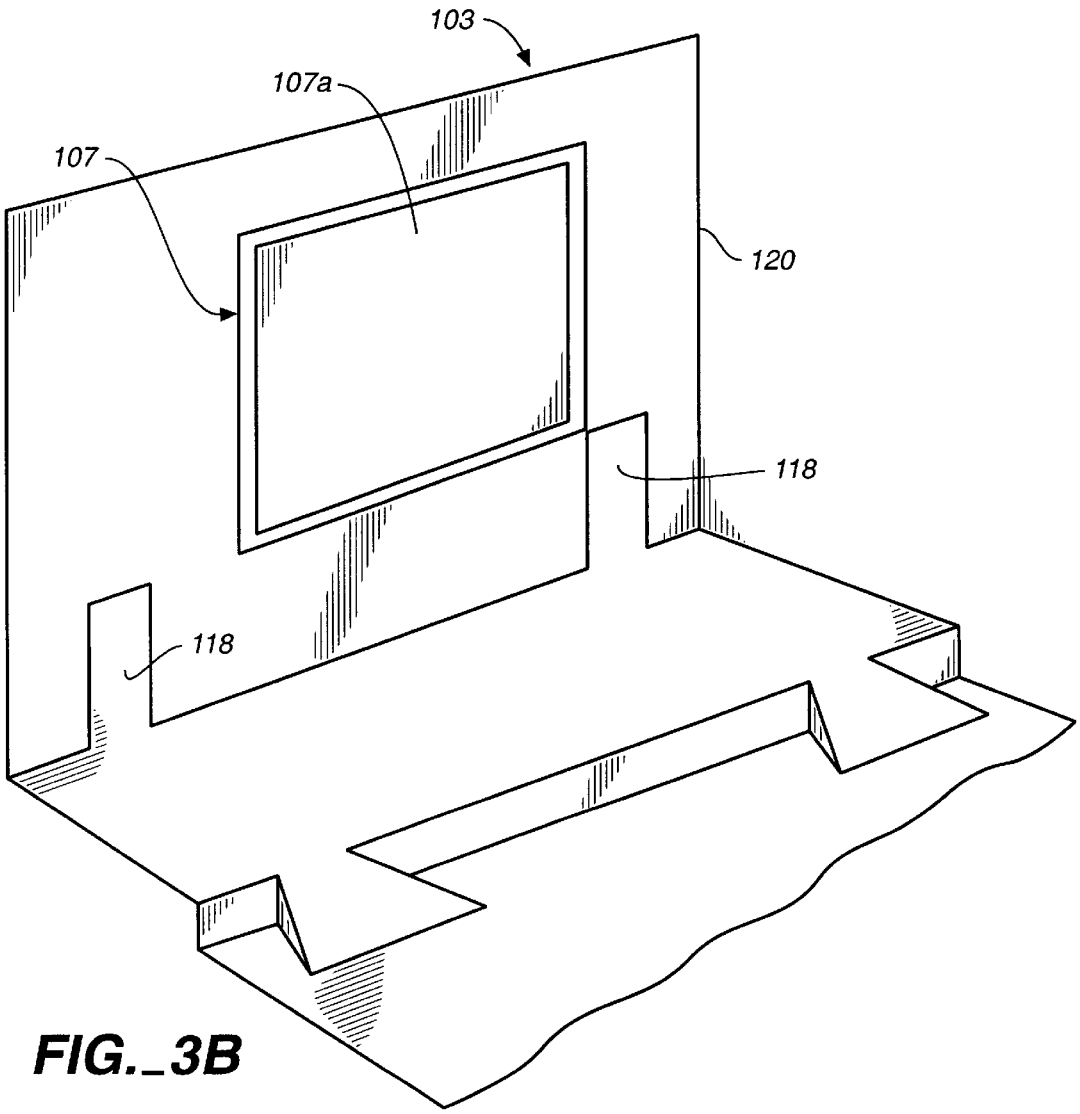
FIG. 3B is a detail perspective view of the stage area of FIG. 3A.

Referring to FIG. 3, the sports, entertainment bar 6 includes a ground level floor 100, seating and bar areas 101, 102, elevated stage means 103 and dance area 104 all supported by the ground level floor 100. Location of the bar 6 is seen to be interior of and between side wall 41*b* of the pair of side walls 41 and the second interior wall 44, as well as between extended portions of front and rear walls 42*b*, 42*a*. A high fidelity sound and video means 106 including a high definition television set 107 is located at the stage means 103. The seating areas 101 are provided with tables 110, chairs 111 and private booths 112. A control room 113 provides for storage of electronic equipment that permits display of either (i) live performances from the concert hall 10 via feed line 115 or (ii) sporting events via feed 116 connected to satellite dish 117, or to transmit images of the live performances of the concert hall 10 to the receivers remote from the latter. FIGS. 3A and 3B show the stage means 103 in more detail wherein doorways 118 are depicted which lead to a pair of parallel walkways at the sides of the television set 107. An upright wall 120 is used to support television screen 107*a* of the television set 107. Returning to FIG. 3, stairs 118 and an elevator 119 connect the bar 6 with the business office area 7.

Business Office Area 7

Figure 5:
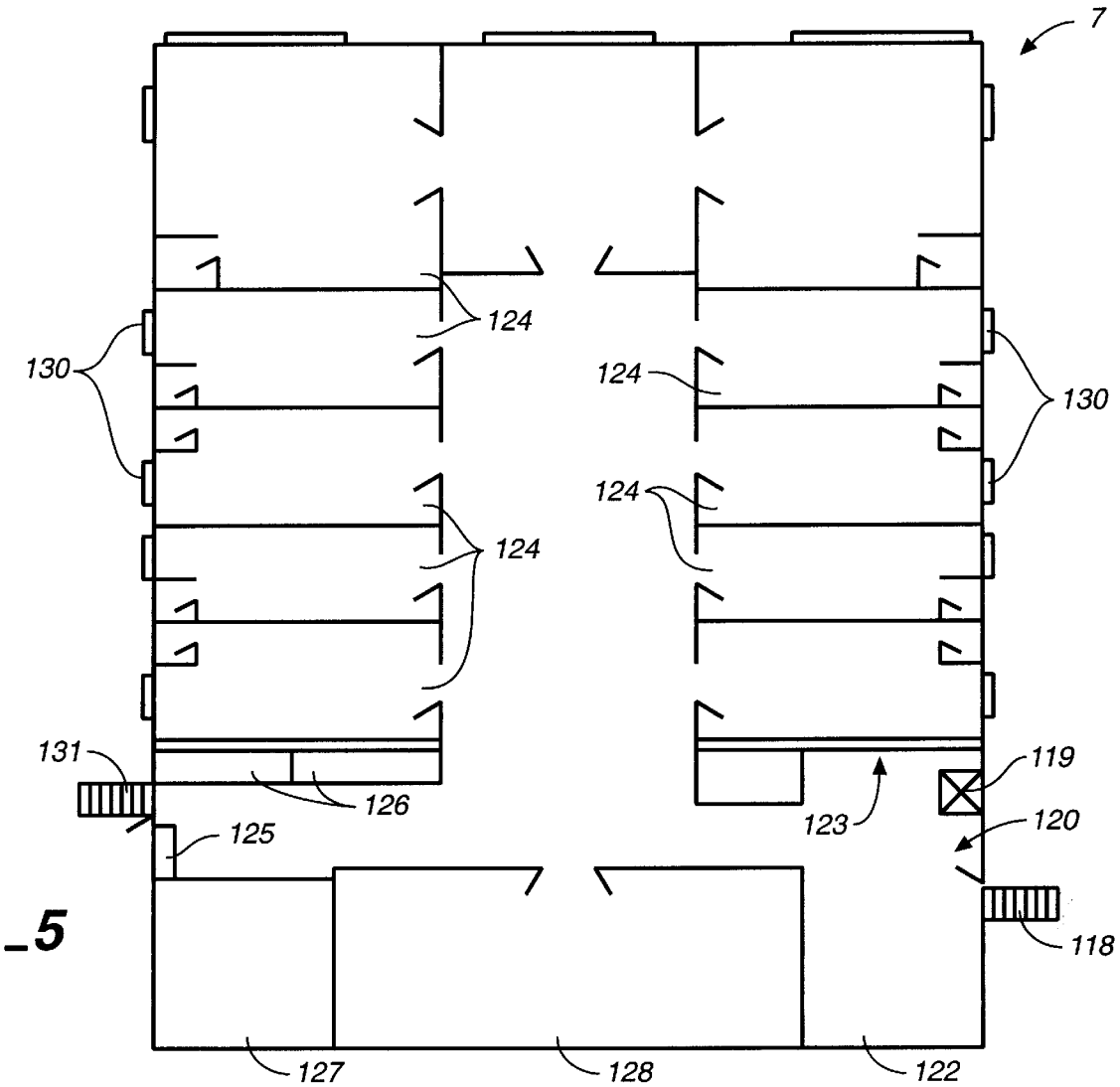
FIG. 5 is a detail plan view of the business area of FIG. 3.

With reference to FIG. 5, the business office area 7 includes an upper landing 120 of the stairs 118 and elevator 119 previously mentioned, a lounge area 122, a reception area 123, a series of offices 124, storage areas 125, bathrooms 126, a kitchen 127 and a conference room 128. The offices 124 have windows 130. Emergency stairs 131 are also provided.

While the invention has been described in combination with specific embodiment, many alternatives, modifications and variations will become apparent to skilled in the art in light of the foregoing description without departing from the scope and spirit of the invention as set forth in the claims.

What is claimed:

1. A multifunctional complex incorporating multiple uses comprises a series of upright wall members arranged to form a rectangularly shaped structure in cross section, said wall members including a first interior wall dividing said structure into a sports/entertainment bar at ground level and a separate concert hall, said concert hall including stage means excavated below ground level, a truncated annular dance floor surrounding said stage means also excavated below ground level and a series of truncated pie-shaped audience seating sections radiating upwardly from said dance floor, said stage means including a rotatable central stage and a plurality of pie shaped stationary platforms radially located about said rotatable central stage, said central stage having a top surface a distance (H) above said dance floor where (H) is in a range of 4 to 10 feet, a circumferentially extending side face and an axis of rotation, each of said plurality of pie shaped stationary platforms being inversely disposed relative to said circumferentially extending side face of said central stage and including an apex segment remote from said side face, a radial axis of symmetry intersecting said axis of rotation, a vertical plane through said radial axis of symmetry normal to said dance floor that bisects each of said plurality of pie shaped platform, and non-apex segment closely adjacent said circumferentially extending side surface whereby an entertainer can easily step from said central stage to each of said plurality of pie shaped stationary platforms, each of said truncated pie-shaped audience seating sections being inversely disposed relative to said dance floor and including a non-apex segment located adjacent to said dance floor and radiating upward therefrom terminating in an apex segment remote from said dance floor, a plurality of tiered rows of open seating, the lowest of which being at height (H) above said dance floor so that entertainers on said stage means can be seen even when dancers are present on said dance floor, an axis of symmetry intersecting said axis of symmetry of each of said plurality of pie shaped stationary platforms, said apex segment remove from said dance floor terming in an individual suite, a radial axis of symmetry intersecting said axis of rotation, and a vertical plane through aid radial axis of symmetry normal to dance floor that bisects each of said series of pie shaped audience seating sections.

2. The multifunctional complex of claim 1 in which said wall members of said multifunctional complex includes a pair of parallel side walls, a back wall, a front wall parallel to said back wall and normal to said pair of side walls and a second interior wall parallel to said front and back walls, said first interior wall being located within and parallel to said pair of side walls and having ends in contact with said front and back walls to create said sport/entertainment bar to one side thereof and said concert hall to an opposite side thereof.

3. The multifunctional complex of claim 2 in which said concert hall includes a first ground level floor segment that starts from said first and second interior walls and one of said pair of side walls and extends inwardly toward said axis of rotation of said rotatable central stage terminating at an imaginary circle concentric of and defined by said axis of rotation, and a second floor segment starting at said concentric circle and being angled downwardly therefrom and terminating at said dance floor.

4. The multifunction complex of claim 1 in which said suite of each of said plurality of truncated pie-shaped audience seating sections is situated at the rear of said plurality of tiered rows of open seating and including seating areas, has unobstructed sight lines to said stage means, sliding glass means and video and sound means for enhancing the viewability of the entertainers on said stage means.

5. The multifunctional complex of claim 1 in which said concert hall includes a system of aisles consisting of main aisles, gallery aisles and a stage aisle, said main aisles being located between adjacent and neighboring pairs of said series of said pie shaped seating sections, said gallery aisles being located along sides of said apex and non-apex segments of each of said series of pie shaped seating sections.

6. The multifunctional complex of claim 1 in which said stage means is star shaped in cross section.

7. The multifunctional complex of claim 1 in which sports/entertainment bar includes seating and bar areas, an elevated stage means and video and sound means located at said elevated stage means of said sports/entertainment bar.

8. The multifunctional complex of claim 7 in which video and sound means allows display of one of (i) live performances from said concert hall and (ii) televised events occurring exterior of said concert hall.

9. The multifunctional complex of claim 1 in which said upright wall members defining said sports/entertainment bar include upper extensions, a second story floor attached to said upper extensions said second story floor being located above said sports/entertainment bar, a business areas supported by said second story floor.

10. The multifunctional complex of claim 9 in which said business area includes a series of offices, bathrooms, a reception area and a conference room.

11. A multifunctional complex incorporating multiple uses comprises a series of upright wall members arranged to form a rectangularly shaped structure in cross section, said wall members including a first interior wall dividing said structure into a sports/entertainment bar at ground level and a separate concert hall, said concert hall including stage means excavated below ground level, a truncated annular dance floor surrounding said stage means also excavated below ground level and a series of truncated pie-shaped audience seating sections radiating upwardly from said dance floor, said stage means including a rotatable central stage and a plurality of pie shaped stationary platforms radially located about said rotatable central stage, said central stage having a top surface a distance (H) above said dance floor where (H) is in a range of 4 to 10 feet, a circumferentially extending side face and an axis of rotation, each of said plurality of pie shaped stationary platforms being inversely disposed relative to said circumferentially extending side face of said central stage and including an apex segment remote from said side face, a radial axis of symmetry intersecting said axis of rotation, a vertical plane through said radial axis of symmetry normal to said dance floor that bisects each of said plurality of pie shaped platform, and non-apex segment closely adjacent said circumferentially extending side surface whereby an entertainer can easily step from said central stage to each of said plurality of pie shaped stationary platforms, said stage means resembling a star shape in cross section.

12. The multifunctional complex of claim 11 in which each of said truncated pie-shaped audience seating sections is inversely disposed relative to said dance floor and includes a non-apex segment located adjacent to said dance floor and radiating upward therefrom terminating in an apex segment remote from said dance floor, a plurality of tiered rows of open seating, the lowest of which being at height (H) above said dance floor so that entertainers on said stage means can be seen even when dancers are present on said dance floor, an axis of symmetry intersecting said axis of symmetry of each of said plurality of pie shaped stationary platforms, said apex segment remote from said dance floor terming in an individual suite, a radial axis of symmetry intersecting said axis of rotation, and a vertical plane through aid radial axis of symmetry normal to dance floor that bisects each of said series of pie shaped audience seating sections.

13. The multifunctional complex of claim 11 in which said wall members of said multifunctional complex includes a pair of parallel side walls, a back wall, a front wall parallel to said back wall and normal to said pair of side walls and a second interior wall parallel to said front and back walls, said first interior wall being located within and parallel to said pair of side walls and having ends in contact with said front and back walls to create said sport/entertainment bar to one side thereof and said concert hall to an opposite side thereof.

14. The multifunctional complex of claim 12 in which said concert hall includes a first ground level floor segment that starts from said first and second interior walls of said concert hall and one of said pair of side walls of said concert hall and extends inwardly toward said axis of rotation of said rotatable central stage terminating at an imaginary circle concentric of and defined by said axis of rotation, and a second floor segment starting at said concentric circle and being angled downwardly therefrom and terminating at said dance floor.

15. The multifunction complex of claim 11 in which said suite of each of said plurality of truncated pie-shaped audience seating sections is situated at the rear of said plurality of tiered rows of open seating and including seating areas, has unobstructed sight lines to said stage means, sliding glass means and video and sound means for enhancing the viewability of the entertainers on said stage means.

16. The multifunctional complex of claim 11 in which said concert hall includes a system of aisles consisting of main aisles, gallery aisles and a stage aisle, said main aisles being located between adjacent and neighboring pairs of said series of said pie shaped seating sections, said gallery aisles being located along sides of said apex and non-apex segments of each of said series of pie shaped seating sections.

17. The multifunctional complex of claim 11 in which said stage means is star shaped in cross section.

* * * * *